United States Patent [19]

Felter

[11] Patent Number: 4,659,057

[45] Date of Patent: Apr. 21, 1987

[54] TILT UP CONCRETE WALL PANEL SYSTEM

[76] Inventor: John V. Felter, P.O. Box 7464, Houston, Tex. 77248

[21] Appl. No.: 748,931

[22] Filed: Jun. 26, 1985

[51] Int. Cl.[4] ..... B28B 7/08

[52] U.S. Cl. ..... 249/97; 249/18; 249/30; 249/32; 249/137; 249/145; 249/176; 249/177

[58] Field of Search ..... 249/18, 30, 31, 32, 249/60, 64, 83, 137, 145, 157, 176, 177, 97, 96; 264/35

[56] References Cited

U.S. PATENT DOCUMENTS

| | | | |
|---|---|---|---|
| 1,670,243 | 5/1928 | Danis | 249/32 |
| 1,773,454 | 8/1930 | Fowler | 425/123 |
| 2,734,250 | 2/1956 | Thompson | 249/177 |
| 4,056,912 | 11/1977 | Case et al. | 52/745 |
| 4,121,804 | 10/1978 | O'Leary | 249/157 |
| 4,378,203 | 3/1983 | Nayagam | 425/111 |

FOREIGN PATENT DOCUMENTS

| | | | |
|---|---|---|---|
| 1502681 | 3/1978 | United Kingdom | 249/145 |
| 2122129 | 1/1984 | United Kingdom | 249/86 |

*Primary Examiner*—Jay H. Woo
*Assistant Examiner*—James C. Housel
*Attorney, Agent, or Firm*—Nies, Webner, Kurz & Bergert

[57] ABSTRACT

System for forming concrete tilt up wall panels, wherein a plurality of form pans are assembled on guide bars resting on a flat surface by receiving lugs on the guide bars into openings in flanges of the form pans, the flanges of adjacent form pans being overlapped and being engaged with common guide bar lugs. The form pan assembly is surrounded by metal members forming a boundary for the overall form. Inserts may be placed in the forms for providing connections for lifting, and for propping up the finished wall panel. Several connection appliances are provided by the invention.

3 Claims, 14 Drawing Figures

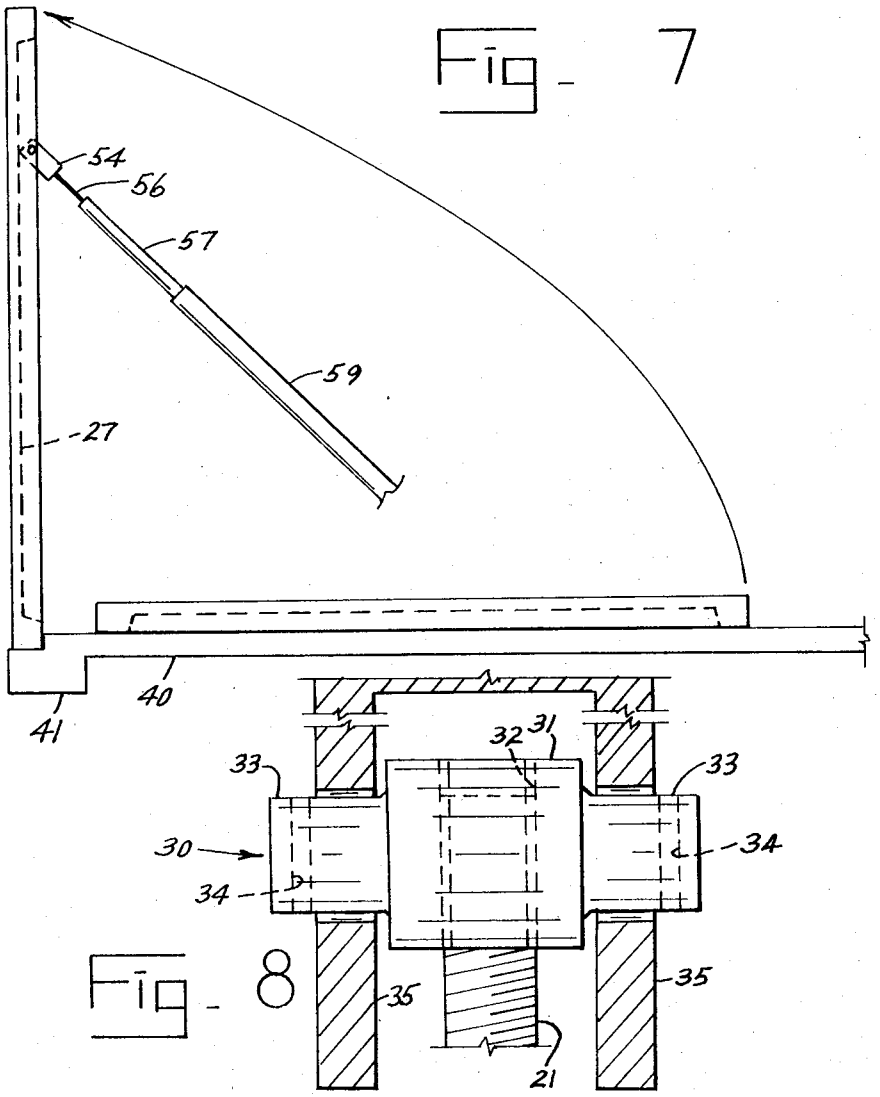
Fig. 7
Fig. 8
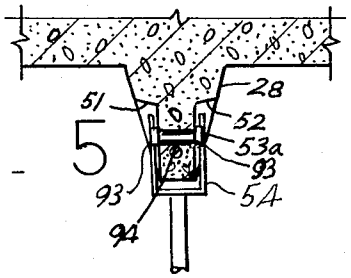
Fig. 5
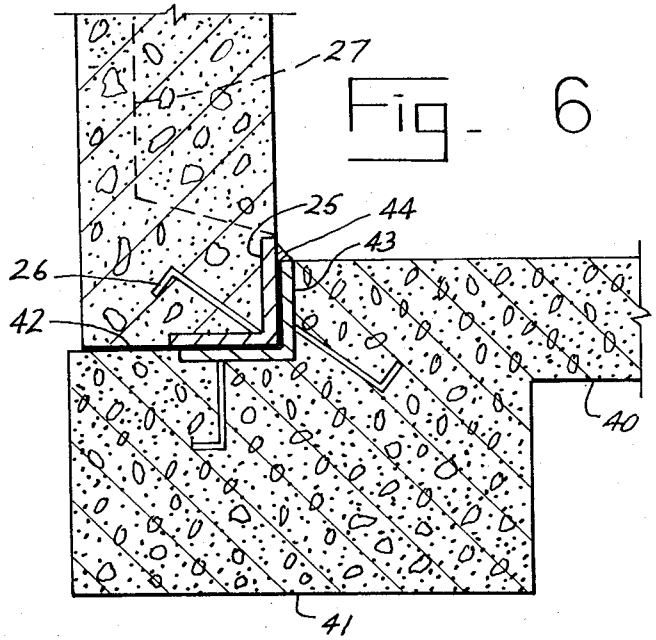
Fig. 6

TILT UP CONCRETE WALL PANEL SYSTEM

BACKGROUND OF THE INVENTION

Concrete tilt up walls have been used for a fairly long period of time in the construction industry. Construction of tilt up walls of the type contemplated has, however, been beset by a number of problems. Tilting up of concrete slab walls is difficult because of the very heavy weights of the wall slabs. Once the concrete slabs have been moved to upright condition, keeping them there has also been a problem. Removal of the forms from the poured and set slabs presents additional problems. Construction of the form for the walls has been time consuming and costly, and often the forms cannot be used repeatedly, but must be constructed specially for the wall slab to be poured. When the slabs are poured away from the job site, transportation and handling difficulties are encountered. This invention seeks to provide methods and apparatus for forming concrete wall slabs of reduced cost, of reduced weight, and without the problems mentioned above, and others.

SUMMARY OF THE INVENTION

The invention provides methods and apparatus for construction of concrete tilt up wall slabs, and for their erection. Modular form pans are disposed on guide bars which properly locate and interconnect the pans into a complete form for a concrete wall panel. The complete form includes surrounding members which tie the whole assembly together and complete the form.

After concrete has been poured to fill the form, the form elements are removed from the concrete wall panel, and can be reused in additional form assemblies. The concrete panel is equipped with connection units so that it can be easily handled and propped up in vertical disposition for assembly into a complete building structure.

The modular pans create regular indentations or recessed areas in the concrete wall panel, reducing its weight so that it may be readily lifted and positioned, yet not reducing its strength and utility. The recesses may be disposed at ether the inside or outside of a building wall.

The recesses contribute to considerable savings in the amount of concrete required, and the rapid assembly and disassembly of the forms greatly reduces construction time, effort and cost. The form elements are adapted for use with walls of differing dimensions, so can be used for a variety of building designs.

A principal object of the invention is to provide methods and apparatus for construction of tilt up concrete wall panels. Another object of the invention is to provide such methods and apparatus enabling rapid assembly of wall panel forms, with resultant advantages. Yet another object of the invention is to provide such methods and apparatus which provide superior wall panels of reduced weight, great strength, and high utility. Still another advantage of the invention is to provide such methods and apparatus, and methods and apparatus for handling of same, in a complete construction package. Still another object of the invention is to provide such methods and apparatus which result in concrete wall panels of improved appearance. A further object of the invention is to provide such methods and apparatus which are economical, dependable, simple in use, and superior.

Other objects and advantages of the invention will appear from the following descriptions of preferred embodiments, reference being made to the accompanying drawings.

BRIEF DESCRIPTIONS OF THE DRAWINGS

FIG. 5 is a partial cross section showing the manner of use of the appratus shown in FIG. 4.

FIG. 6 is a vertical cross section showing the method for securing the concrete wall panels in vertical disposition in a structure.

FIG. 7 is a schematic drawing indicating the method for erecting a wall panel according to the invention.

FIG. 8 is a side elevation of a connection element provided according to the invention.

DESCRIPTIONS OF THE PREFERRED EMBODIMENTS

Figures 1, 2:
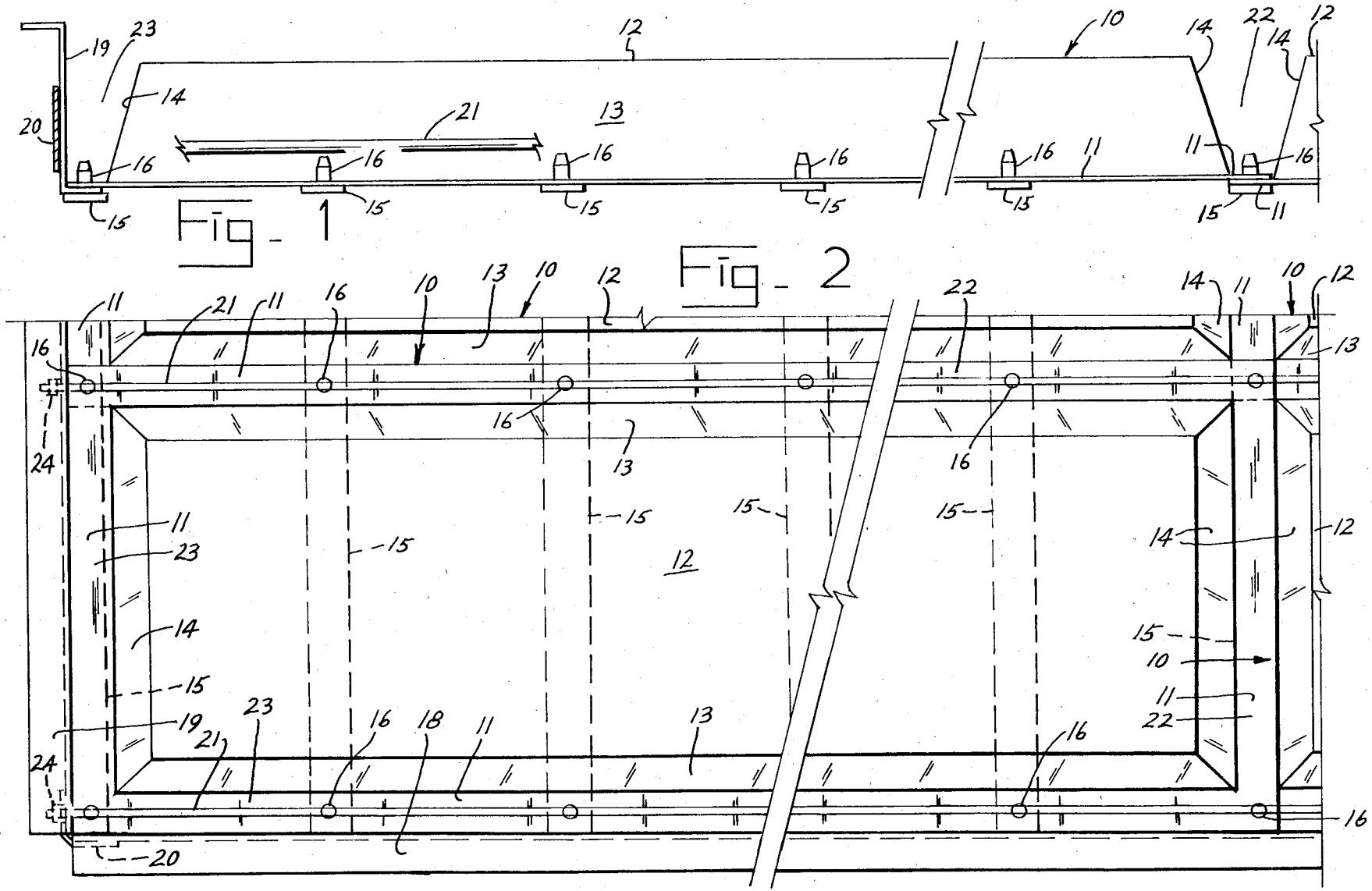
FIG. 1 is a side elevation of a portion of a form pan assembly of preferred form according to the invention.
FIG. 2 is a top view of the apparatus shown in FIG. 1.

Referring now to the drawings in detail, and first to FIGS. 1 and 2, the preferred apparatus includes a plurality of form pans 10, four being shown in FIG. 2, one pan being completely shown and three pans being incompletely shown. Each pan 10 has a surrounding horizontal flange 11, the flanges of adjacent pans 10 being overlapped, as can best be seen in FIG. 1. The pans are used in inverted positions, with the flat bottom 12 up, the slanted sides 13 and ends 14 sloped outwardly and downwardly to the surrounding flange 11. The pans 10 are located and held in position by a plurality of guide bars 15 which have short lugs 16 welded thereto at spaced positions along their lengths. The lugs are beveled inwardly at their upper ends to be easily insertable in circular holes in the flanges 11. Where two pans 10 are adjacently together, the flanges of the two pans are overlapped and the holes of each are disposed over the same lugs 16.

To assemble a plurality of pans 10 to form a complete form for a wall panel, the bars 15 are laid on a floor or other preferably flat surface, spaced parallely by the distance between the holes of the flanges 11. First, one pan 10 is placed across the bars, with the holes of its flange 11 having the lugs 16 of the bars disposed therethrough. Then, additional pans 10 are put into place, the flanges 11 overlapped, with the lugs 16 disposed through the holes of the flanges 11, as shown in FIGS. 1 and 2. Depending on the size of the wall panel to be poured, any number of pans 10 may be assembled on bers 15 to make a form corresponding to the size of the wall panel desired. After the pans 10 have been assembled on the bars 15, a channel member 18 is set along each side of the outermost pans, and a Z-bar 19 is set along each end of the outermost pans. At the corners of the form, the channels 18 and Z-bars 19 are connected by the angle brackets 20, bolted through holes provided through the channels, Z-bars, and brackets (see FIGS. 2 and 3).

Next, reinforcing bars 21 are installed, each bar 21 extending through a hole through a Z-bar at each end and disposed along a trough 22 formed between the facing side walls 13 of adjacent pans 10 or along a trough 23 formed between a channel 18 and a pan sidewall 13. The ends of the reinforcing bars 21 are threaded and nuts 24 are screwed thereonto, so that the Z-bars 19 are held inward and the reinforcing bars are drawn fairly tight to extend fairly straight through the troughs.

At what are to be the bottom corners of the panels, one or more lengths of angle irons 25 are set in place inside of the Z-bars in the position shown in FIG. 6, the angle irons 25 being anchored later in concrete by the angle rods 26 welded thereto.

The recesses formed in the concrete panel by the pan shape are referred to by reference numerals 27. The concrete set in the troughs between facing sides 13 and between a side 13 and a channel 18 are referred to by reference numerals 28. The beams 28 reinforce the slabs 29 formed above the pans 10.

Figure 3:
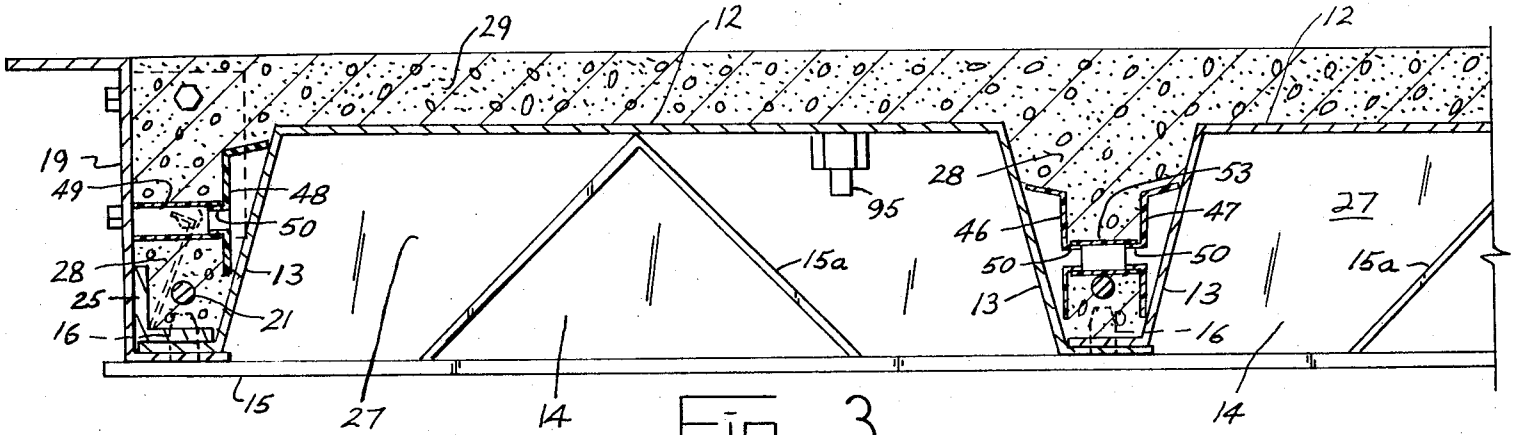
FIG. 3 is a vertical cross section taken at line 3—3 of FIG. 2.

The angular members 15*a* on bars 15, FIG. 3, support tops 12 of pans 10 during concrete pouring.

Figure 9:
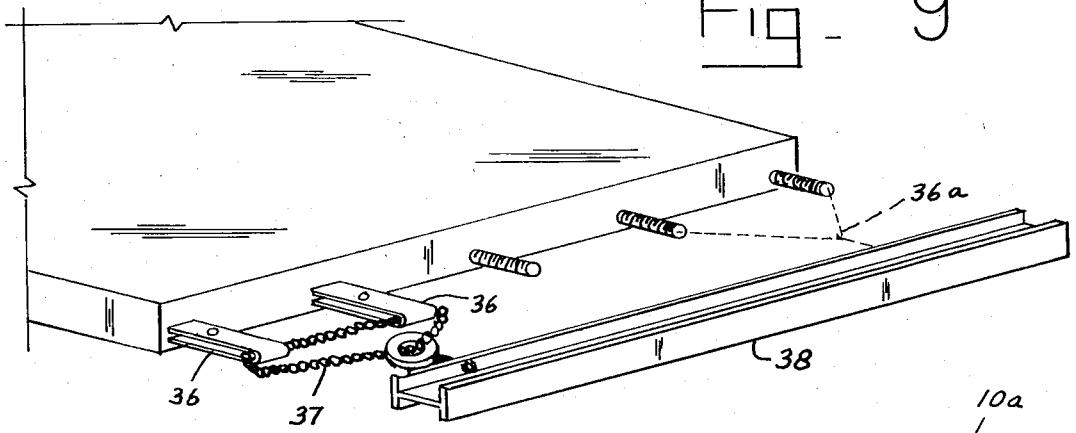
FIG. 9 is an upper perspective view showing the method and apparatus for connection of a lifting means to a panel according to the invention.

Referring now to FIGS. 8–9 of the drawings, the fitting 30 shown in FIG. 8 is used in lifting of the panels after they have been poured and set. The cylindrical body 31 has a tapped opening 32 therethrough adapted for screwing onto the threaded end of a reinforcing bar 21. As mentioned earlier, the bars 21 are threaded at their ends to receive the nuts 24. After the concrete is set in the form, the nuts 24 are removed, and the corner brackets 20 are unbolted, after which the Z-bar may be removed from the end of the panel. The fittings 30 each have opposite ends of reduced diameter, reference numerals 33, each of which has a drilled hole 34 therethrough near its end. The arms 35 of a yoke connector 36 are perforated to be received over the reduced diameter fitting portions, and retained by a cotter pin or like stop to prevent arms 35 from removal from the fitting 30. As shown in FIG. 9, the fittings 30 are screwed onto bars 21 first and second from the sides of the concrete panel, with a fitting connector 36 fixed to each. Only one pair of connectors 36 is fully shown, the other pair being indicated schematically by dashed lines 36*a*. A chain 37 is passed through the opening of an eye bolted to a beam 38 at each side of the panel. Then the beam 38 may be lifted by a crane or hoist, not shown, to lift the panel. Since the bars 21 extend through the full length of the concrete panel, the bar 38 connection to the panel is strong and not subject to failure, and the crane or hoist can pick the panel completely off the floor so that the panel can be moved to its proper location in the structure and can be rotated to present either face toward the exterior of the structure. The foregoing is possible because the panel is much lighter in weight than the usual tilt up wall panel, because of the recesses 27 which eliminate a considerable volume of concrete, and because of the reliable connection of the crane or hoist thereto. A much smaller crane or hoist can be used than has been possible with conventional types of tilt up concrete wall panels.

In FIG. 6, the concrete floor slab on which the wall panel is poured is indicated by reference numeral 40. A reinforced edge beam 41 has a downwardly recessed outer edge 42 forming a ledge on which the concrete wall panels are supported. An angle iron 43 is set and anchored into beam 41 at the inside angle of recess 42, as shown. When the concrete wall panel is set onto ledge 42, angle iron 25 if the panel abuts angle iron 43 of the beam. After the wall panel is in place, angle iron 25 is welded to angle iron 43 at 44, securing the wall panel to the ledge.

Figure 4:
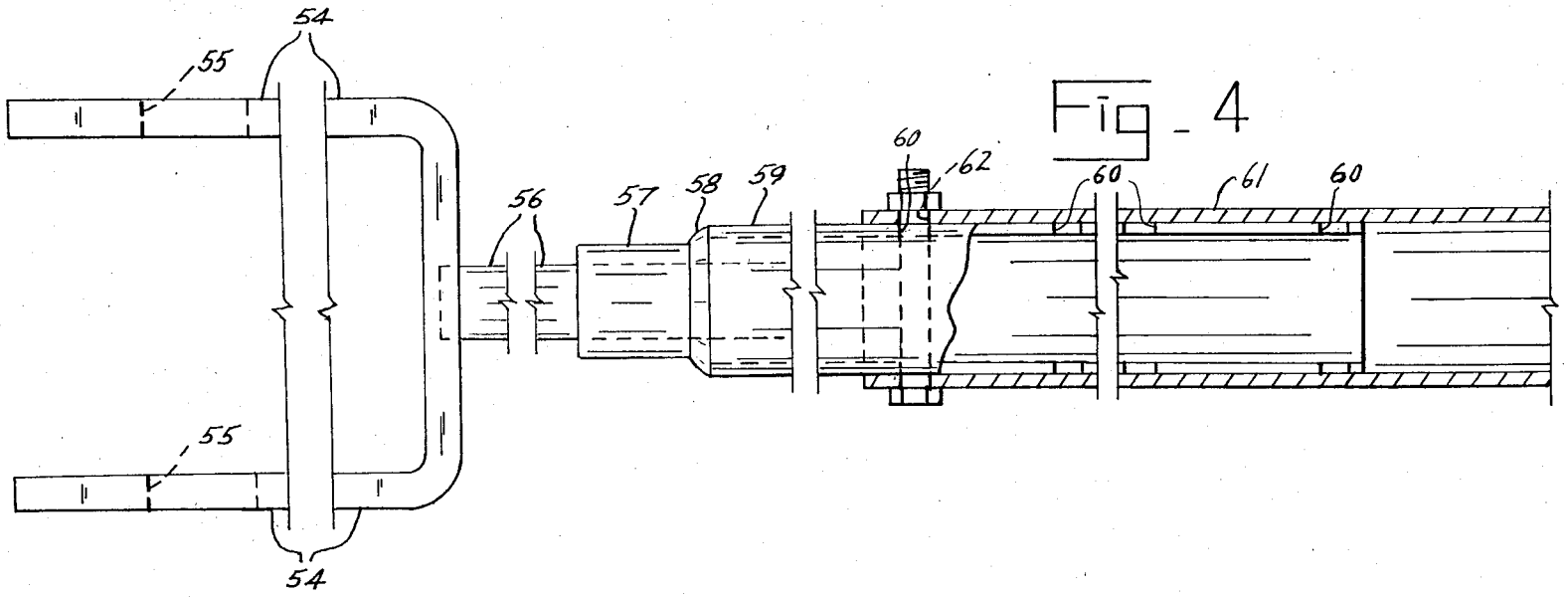
FIG. 4 is a side elevation of a portion of a brace apparatus according to the invention.

Referring to FIGS. 4 and 5 of the drawings, as well as to FIG. 3, plastic inserts 46–48 may be set in place in the form at desired locations. A plastic tube 49 is coupled to the nipple 50 of insert 48, and a plastic tube 50 is coupled between the nipples 50 of inserts 46, 47, as shown. When the concrete is poured and set in the form, the presence of the inserts and tubes causes recesses 51, 52 to be formed in the beam 28, with a cylindrical opening 53 through the beam. The inserts 46–48 and the recesses 51, 52 are, say, 6 to 8 inches long along the length of the beam. As shown in FIG. 5, a yoke element 54 may be coupled to the beam at the opening 53 by placing the arms of the yoke at the oposite ends of the opening and running a pin or bolt through perforations in the yoke arms and the opening through the beam.

The yoke element 54 shown in FIG. 4 may be connected to a beam in the described manner. The apparatus shown in FIG. 5 is a brace or prop useful for holding a wall panel in upright position before it is secured by other means. The yoke 54, having holes 55 through its arms to receive ends 93 of bolt 94, is welded to a rod or bar 56 which is outwardly threaded. Bar 56 screws into the internal threads of a fitting 57 which is welded at 58 to the end of a pipe 59. Pipe 59 has a plurality of holes 60 through its wall, the holes being in opposite pairs along the pipe and being regularly spaced along the length of the pipe. Pipe 59 is telescopically received into a larger pipe 61, which has a pair of opposite holes 62 adjacent its end. By matching a pair of holes of pipe 59 with the holes 62 of pipe 61, the pipes can be fixed together by insertion of a bolt through the aligned holes. By changing to a different pair of holes of pipe 59, the length of the apparatus can be altered. The length of the apparatus may also be adjusted by screwing bar 56 into and out of fitting 57, so that the apparatus length can be made as desired. The right end of the apparatus the left end of which is shown in FIG. 4, is the same, there being a pair of holes 62, a pipe 59 with plural spaced pairs of holes 60, a fitting 57, and a bar 56 at the opposite right hand end of pipe 61. The length adjustments are, therefore, repeated at each end of pipe 61. The threads of bar 56-fitting 57 at one end are of opposite pitch so that the apparatus performs as a turnbuckle.

The yoke arms 54 are placed at opposite sides of a beam 28 which has recesses 51, 52 formed as shown in FIG. 3, using the plastic inserts 46, 47. A pin or bolt 53*a* is inserted to connect the beam 28 to the yoke at one end of the FIG. 4 apparatus. The opposite end of the FIG. 4 apparatus is anchored in any suitable manner to the floor 40 adjacent the base of the wall panel, and the FIG. 4 apparatus acts as a prop to hold the wall panel upright at the proper location and perfectly vertical, as shown in FIG. 7.

The wall panels, when the Z-bars 19 have been removed from a panel end, have the ends of the reinforcing bars 21 protruding therefrom. The threaded ends are used to connect the lifting beam 38 to the panel end using the bodies 31, as has been described. At the bottom ends of the panels, the ends of bars 21 interfere with standing of the panel on its end on ledge 42, so the bar ends must be cut off, usually with a torch, before the wall panel is elevated to vertical position. The upper ends of the bars 21 may also be cut off after the panel has been tilted up, if desired or necessary.

Figure 10:
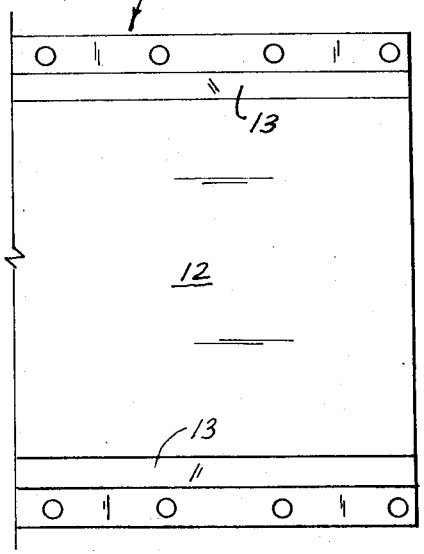
FIG. 10 is a vertical cross section of a portion of the apparatus showing a modified form of the apparatus.
Figure 10:
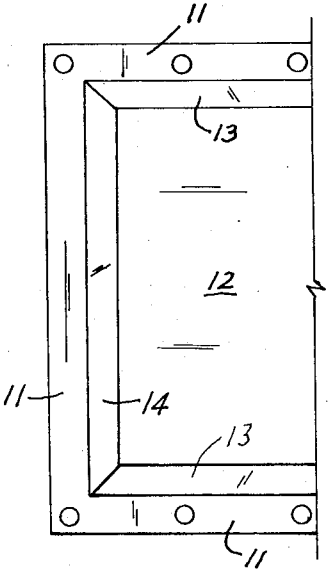
Figure 10:
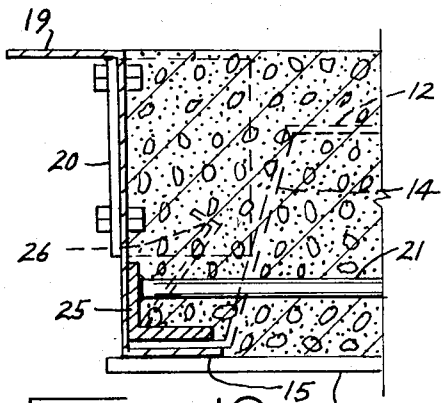

Alternatively, the reinforcing bars may be supported in a different manner at the bottom end of the panel, according to FIG. 10. As shown in FIG. 10, the lower ends of the reinforcing bars may be welded, as at 65, so that cutting off of the bar ends is not necessary before the wall panel is stood up. However, the bar ends must be allowed to project from the panel at the upper end of the panel in order that the lifting beam 38 may be connected as shown in FIG. 9, for tilting up of the panel. At the welds 65, the end of the reinforcing bar 21 is welded to the corner angle iron 25 which is welded to the angle iron 43 set at ledge 42 as shown in FIG. 6.

Figure 14:
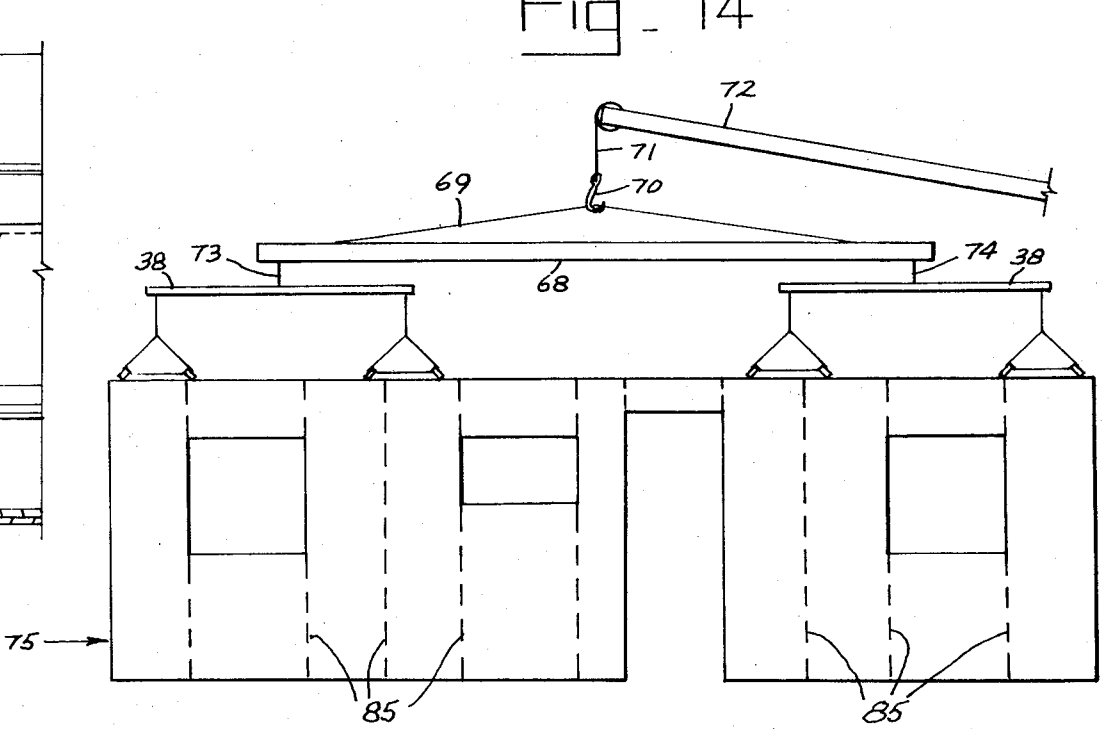
FIG. 14 is a schematic side elevation showing an erection method according to the invention.

In FIG. 14, another example of how a panel may be tilted up to vertical wall position is schematically shown. A longer upper beam 68 is supported by a cable 69 connected thereto at its ends, cable 69 being engaged by a hook 70 carried by cable 71 of the boom arm 72 of a crane. The ends of beam 68 are connected to the centers of two beams 38 by cables or chains 73, 74, details of the connections not being shown, but being conventional. The two beams 38 are each connected to the wall panel 75 at the threaded upper ends of reinforcing bars 21 as already described, using screw on bodies 31 as shown in FIG. 8. As indicated by the drawing, an entire wall panel for one wall of a building may be tilted up in a single procedure. The panel 75 is exemplary, only, and the panel may take other forms. The panel 75 is shown to have windows 76, 77, 78 and door 79, these being formed in the panel by rectangular inserts placed between pans 10, the inserts not being shown, but consisting of four side members connected at the corners by releasable connections such as bolts.

Figure 13:
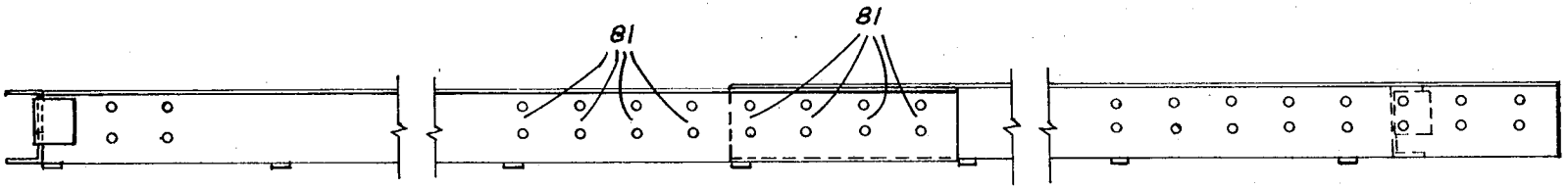
FIG. 13 is a side elevation of yet another modified form of apparatus according to the invention.

In forming a wall panel such as that shown in FIG. 14, it is likely that pans 10 of various sizes will be needed to accomodate the pans with inserts for windows and/or doors or other openings required. Also, the surrounding rectangular frame outside of the pans may have to be varied in lengths of the members. In FIG. 13, there are shown a pair of Z-bars 19*a*, 19*b* each having a plurality of pairs of spaced holes 81. By overlapping the Z-bar ends, and using different aligned pairs of the holes 81, the lengths of the overall Z-bar may be adjusted. By properly spacing the hole pairs, the length of the Z-bar may be varied in one inch increments, so that the width of a panel may be varied by one inch increments. By the method illustrated by the apparatus of FIG. 11, the widths as well as the lengths of the pans 10 may be varied.

Figure 11:
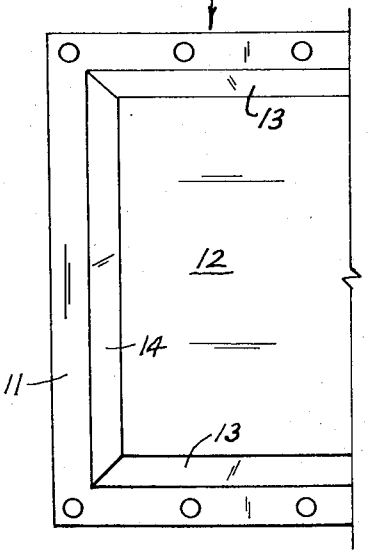
FIG. 11 is a plan view of another apparatus element according to the invention.

Referring now to FIG. 11 of the drawings, a pan 10, as shown in FIGS. 1–2, is shown, end to end with a modified pan lO*a*. Pan lO*a* is like pan 10, except that one end 14 is omitted, the pan lO*a* being open ended. The open end of a pan lO*a* can be telescoped over either end or both ends of a pan 10, to variably increase its length. It is, however, necessary to match the holes in the flanges 11 so that they can be slipped over the lugs 16 of the guide bars 15, in order that the assembly will be held together properly. If the open ended pan lO*a* is longer than the pan 10, then the length of a pan 10 may be increased to more than twice its length, this procedure increasing the spacings of the horizontal concrete beam portions of the panel, but in many structures the horizontal concrete beams are not necessary, anyway. The dashed lines 85 in FIG. 14 indicate the array of pans 10, 10*a* which can be used in forming the wall panel. At any rate, pans 10 may be varied in length, and in width, according to the principal shown and described. The lengths of the guide bars 15, and the spacings of the lugs 16, may be varied as desired to accomodate any size all panel to be formed.

The invention described has many advantages over the prior art. Concrete wall panels may be made at the job site and easily moved to upright position for use in a wall.

Figure 12:
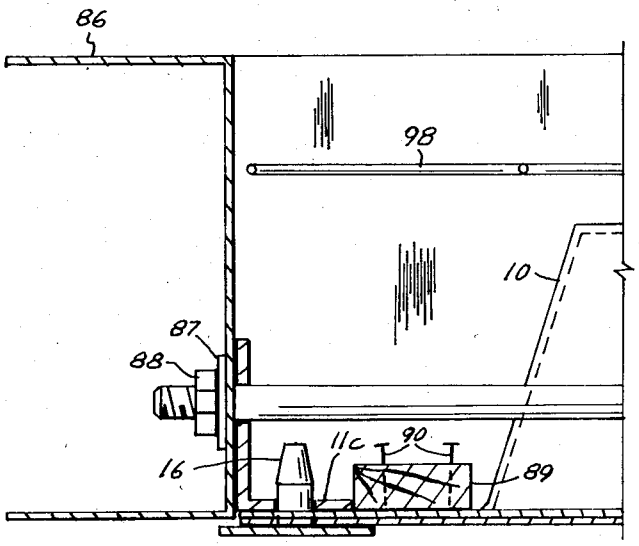
FIG. 12 is a partial vertical cross section showing another modified apparatus according to the invention.

Referring particularly now to FIG. 12 of the drawings, a channel 86 is shown at the ends of the pans 10, with a wider than normal flange ll*c*. The lugs 16 are disposed through openings through flange ll*c* and through openings through angle iron 25*a*. The threaded ends of the reinforcing bars 21 extend through openings through angle iron 25*a* and channel 86, and are secured by washers 87 and nuts 88. A nailing block 89 is shown set on flange ll*a* inward of lugs 16 and angle iron 25 *a*. When concrete is poured and set in this form, the block 89 will be set in the concrete to provide a place where objects may be nailed or screwed to the panel. Nailing pieces may be placed in any desired locations in the panel, such as for example, around window and door openings, so that standard window and door frames may be installed in the openings in the standard manner. The wood pieces may be anchored in the concrete by one or more nails or screws 90 fixed into the piece. It is apparent that a wall panel may be adapted for whatever connections to it are required or desired.

The air valve 95, FIG. 3, is provided to assist in removal of the forms from a panel after the concrete has been poured and set. A hose from a pressured air source can be connected to valve 95, and pressured air injected into the form to dislodge the form from the concrete.

In FIG. 12, reference numeral 98 indicates a welded steel reinforcing mesh.

The forms herein disclosed may be used in conjunction with any other type of concrete form. The channels and Z-bars may be replaced by wood planks or other type of panel apparatus.

It has been estimated that use of the methods and apparatus according to the invention will result in the following savings: a saving of 60% of concrete cost; a saving of 80% of steel cost; a saving of 60% of labor cost; and a saving of 90% of engineering cost. And, the adjustability of the forms enables making of wall panels of virtually any size and design with no additonal costs. The panels are very light in weight as compared with conventional panels, even those conventional panels of so-called "waffle" design, the forms for which are very expensive.

The preceeding descriptions have pointed up the concept of the invention and preferred embodiments thereof. The invention provides a new, novel and useful method and apparatus for making and erecting concrete tilt up wall panels of substantial value in the industry.

While preferred embodiments of the methods and apparatus according to the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Apparatus for forming concrete tilt up wall panels comprising a plurality of form pans, each having a surrounding flange portion, and having a central raised portion sloped downward to said flange portion around its sides, said flange portion having spaced holes therealong, a plurality of parallel spaced guide bars, each guide bar having upwardly projecting lugs uniformly spaced therealong, each of said pans being disposed across a plurality of said guide bars with said guide bar lugs received through said holes to position said pans, said flange portions of adjacent pans being overlapped and common ones of said lugs being received through said holes of said overlapped flange portions, selected ones of said guide bars extending across said pans beneath the central raised portions thereof, support members carried by said selected ones of said guide bars and extending upwardly therefrom into engagement with said central raised portion of said pans to support said pans, said pans defining troughs between said central raised portions, and above said flange portions, side frame members closely disposed along the sides of the outermost of said pans, end frame members closely disposed along the ends of the outermost of said pans, means connecting said side and end frame members to form a rectangular frame closely surrounding said pans and extending above said central raised portions and reinforcing bars extending along said troughs between said pans.

2. The combination of claim 1, at least one end of said reinforcing bars being threaded and extending through openings in said end frame members, the other end of said reinforcing bars being welded to said end frame members whereby said reinforcing bars do not protrude at one end of said concrete wall panel.

3. The combination of claim 1, including at least one additional form pan having an open end, whereby said additional form pan may be disposed over an end of one of said form pans to alter its length.

* * * * *